United States Patent [19]

Giordano et al.

[11] 4,372,145

[45] Feb. 8, 1983

[54] CONDUIT BENDING APPARATUS

[76] Inventors: Anthony P. Giordano, 460 Mill Springs La., Plantation Acres; Michael G. Mauer, Jr., 11780 Hermitage Dr., Plantation, both of Fla. 33325

[21] Appl. No.: 248,855

[22] Filed: Mar. 30, 1981

[51] Int. Cl.[3] ..... B21D 9/05

[52] U.S. Cl. ..... 72/387; 72/389; 72/457

[58] Field of Search ..... 72/388, 387, 381, 380, 72/457, 458

[56] References Cited

U.S. PATENT DOCUMENTS

| | | | |
|---|---|---|---|
| 1,075,837 | 10/1913 | Malo et al. . | |
| 1,267,798 | 5/1918 | Parnell . | |
| 1,688,199 | 10/1928 | Meier . | |
| 1,754,635 | 4/1930 | McCarthy . | |
| 1,835,264 | 12/1931 | Blythe . | |
| 3,145,757 | 8/1964 | Sheehan | 72/387 |
| 3,507,141 | 4/1970 | Fisher | 72/389 |
| 3,691,815 | 9/1972 | Deacon | 72/458 |
| 3,824,835 | 7/1974 | Jackson | 72/389 |

*Primary Examiner*—Gene Crosby
*Attorney, Agent, or Firm*—Oltman and Flynn

[57] ABSTRACT

For bending wiring conduits projecting up from the floor of a building under construction, the present apparatus has a padded block providing a lower abutment, a grooved block providing an upper abutment located above and behind the lower abutment, and a jaw pivotally movable from a retracted position on the opposite side of the conduits from the lower and upper abutments to an extended position toward the upper abutment to force the conduits against the padded block for forming lower bends in the conduits. The jaw has a grooved convex face which engages the conduits to form upper bends of the opposite curvature in the conduits between the lower and upper abutments. The padded block is adjustable to determine the amount the conduits are bent. The grooves in the convex face of the jaw are laterally spaced to spread the conduits apart laterally from their spacing at the floor. A manually pivoted handle actuates the jaw through a mechanical linkage.

7 Claims, 11 Drawing Figures

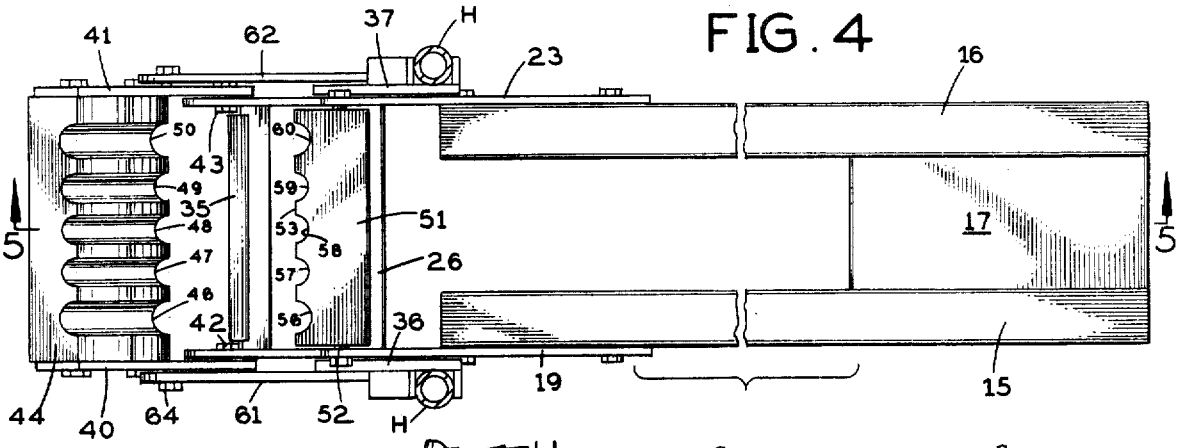
FIG. 4
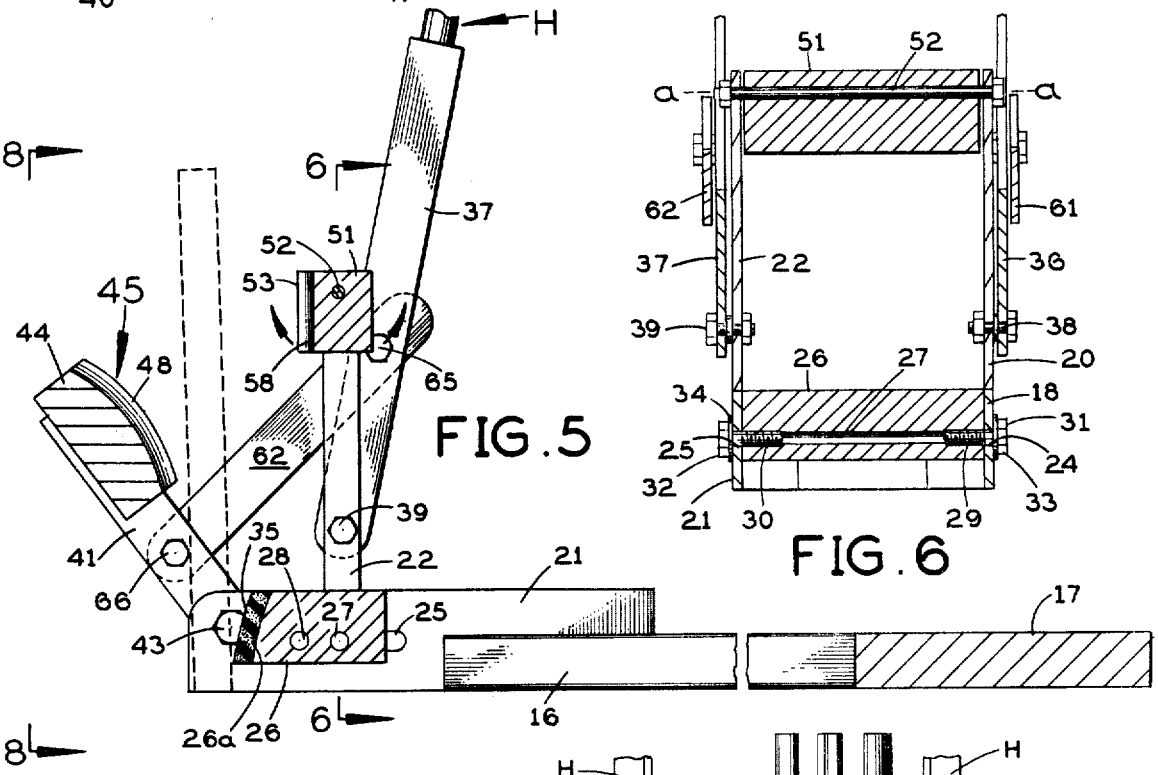
FIG. 5
FIG. 6
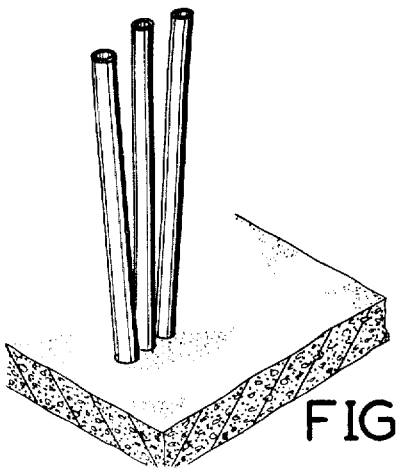
FIG. 7
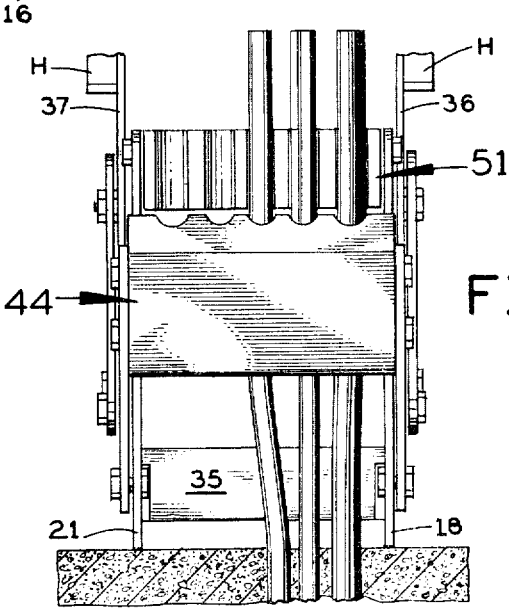
FIG. 8

CONDUIT BENDING APPARATUS

SUMMARY OF THE INVENTION

This invention relates to an apparatus for forming offsets in conduits in a building under construction, particularly electrical wiring conduits projecting up from a floor of the building.

Various pipe bending devices have been proposed heretofore for bending metal pipes, such as plumbing pipes or electrical wiring conduits. Generally, such prior devices have been designed to form a single bend in the pipe or conduit, usually a right angle bend.

The present apparatus is constructed to provide two successive bends of opposite curvature in a conduit which leave its bent end generally parallel to, and offset from, the remainder of the conduit. This apparatus is particularly useful in forming offsets in wiring conduits which project up from concrete floors in buildings under construction at the location of yet-to-be-erected walls of the building in which electrical outlets will be located. Usually the floor locations of such conduits do not correspond exactly to the front-to-back in-the-wall locations where their upper ends will fit in the junction box behind the electrical outlet. The common practice has been to bend the upper ends of these conduits manually or with a hand bender, a procedure which is unnecessarily time consuming and expensive. In addition, the wiring conduits usually must be spread apart laterally from their floor locations to position them to register properly with the corresponding openings in the junction box.

The present invention is directed to a novel apparatus for bending electrical conduits to achieve both the desired front-to-back offset and lateral spreading from the positions of the conduits in the floor.

A principal object of this invention is to provide a novel and improved apparatus for bending electrical conduits which project up from the floor of a building under construction so that the upper ends of the conduits will be located properly with respect to the junction box which will be located behind an electrical outlet in a wall of the building.

Another object of this invention is to provide such an apparatus which offsets the upper end of each conduit from its floor position by forming two successive bends of opposite curvature in the conduit.

Another object of this invention is to provide a conduit bending apparatus as just described which is adjustable to change the amount of the offset formed in the conduit.

Another object of this invention is to provide such an apparatus which spreads apart the upper ends of wiring conduits projecting up from the floor of a building under construction.

Further objects of this invention will appear from the following description and appended claims, reference being had to the accompanying drawings forming a part of this specification wherein like reference characters designate corresponding parts in the several views.

DESCRIPTION OF THE DRAWINGS

FIG. 4 is a top plan view of the apparatus taken from line 4—4 in FIG. 1;

FIG. 5 is a longitudinal section taken along the line 5—5 in FIG. 4, with the operating handle of the apparatus in its raised position;

FIG. 6 is a cross-section taken along the line 6—6 in FIG. 5;

FIG. 7 is a top perspective view showing a set of three wiring conduits extending up from a floor of a building under construction before they are bent by the present apparatus;

FIG. 8 is a fragmentary front end view of the present apparatus operating on the conduits shown in FIG. 7, this view being taken from the line 8—8 in FIG. 5;

DETAILED DESCRIPTION

Figure 3:
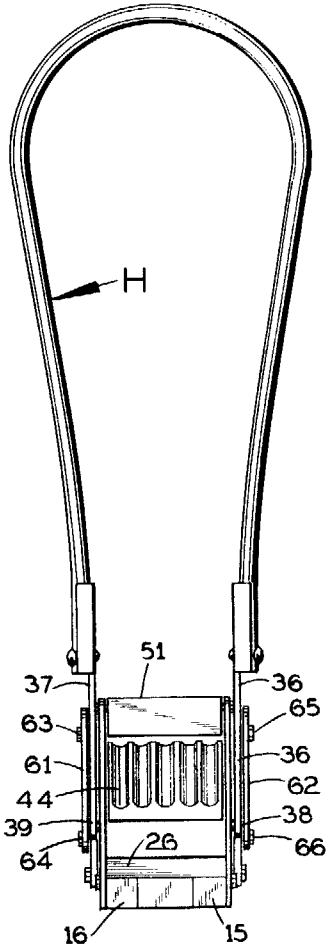
FIG. 3 is a rear elevation.

As best seen in FIG. 4, the present apparatus has a rigid base which includes two laterally spaced, parallel, floor-engaging, side rails 15 and 16 of channel-shaped cross-section which are horizontally elongated. A rectangular block of wood 17 extends between the side rails at the right end of the base in FIG. 4 and is bolted to both rails to provide a foot rest for the user of the apparatus.

At the opposite end of the base a flat side plate 18 (FIG. 1) is bolted to the outside of the side rail 15 and projects slightly above it. A flat diagonal bar 19 is welded at its lower end to the top of the side plate 18 and extends at an acute angle upward and to the left in FIG. 1. A flat vertical bar 20 extends down from the upper end of the diagonal bar 19 to the side plate 18 and is welded to both to form an upstanding, rigid support structure at this side of the base.

A similar support structure is bolted to the opposite side rail 16 of the base at its left end. As shown in FIG. 5, this support structure includes a flat side plate 21 bolted to the outside of the side rail 16, a vertical bar 22 welded to the top of the side plate 21 and extending up from it, and a diagonal bar, not shown in FIG. 5 but shown at 23 in FIG. 4, which extends diagonally at the right in FIG. 5 from the top of the vertical bar down to the top of the side plate 21.

Figure 1:
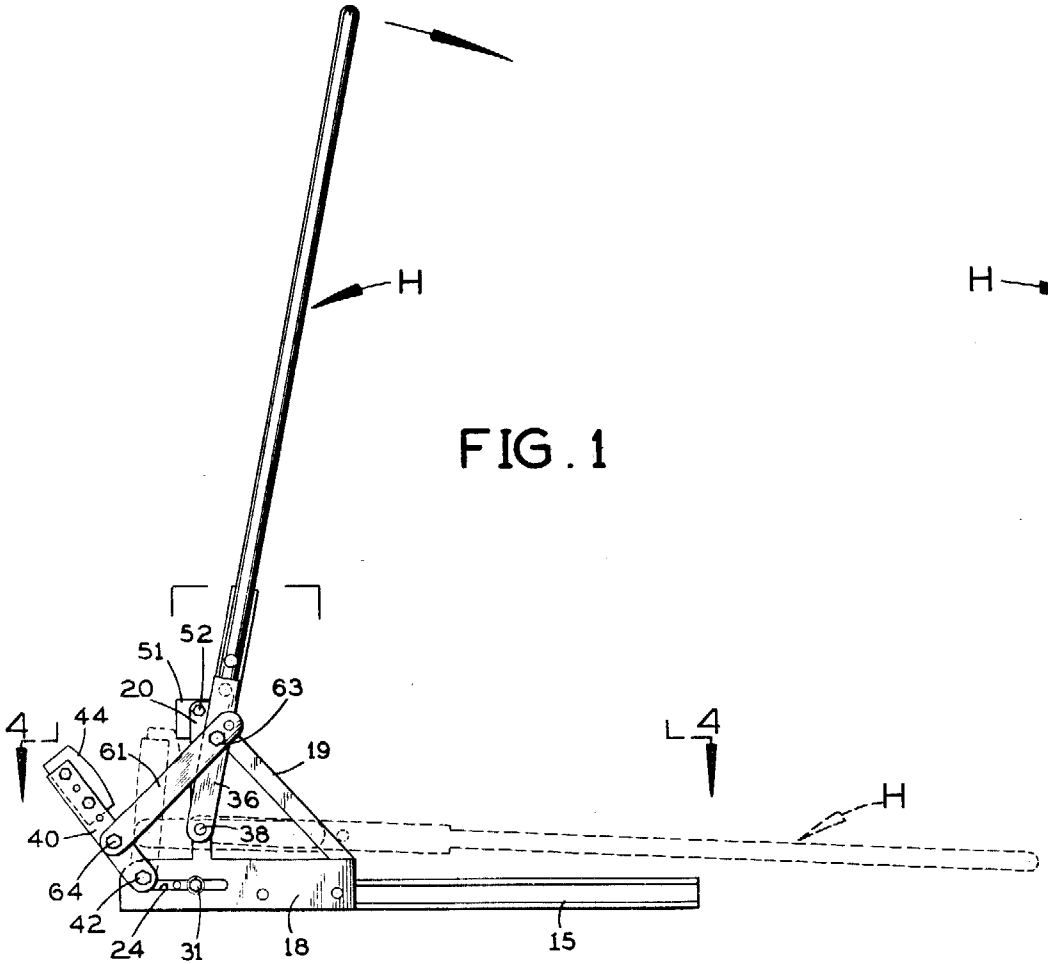
FIG. 1 is a side elevation of a presently preferred embodiment of the present invention, showing its operating handle in full lines in its raised position before bending the conduits and in phantom lines in its lowered position after bending the conduits.

As shown in FIG. 1, the side plate 18 on the base is formed with a horizontally elongated slot 24. As shown in FIG. 5, the opposite side plate 21 on the base is formed with a similar slot 25, which is aligned with slot 24. As shown for the slot 25 in FIG. 5, both slots 24 and 25 are located completely beyond the adjacent ends of the base side rails 15 and 16. A rectangular steel block 26 is slidably received between the side plates 18 and 21 on the base where the slots 24 and 25 are located. This block provides a lower abutment at which a lower bend is formed in the conduits, as explained hereinafter. The block 26 is formed with a pair of transverse horizontal bores 27 and 28 in alignment with the slots 24 and 25. As shown in FIG. 6, the bore 27 threadedly receives a pair of bolts 29 and 30 which project slidably through the slots 24 and 25, respectively, and present screwthreaded outer ends at the outside of the side plates 18 and 21, respectively, on which clamping nuts 31 and 32 are threaded. Flat metal washers 33 and 34 are sandwiched between these nuts and the side plates of the base. A similar bolt, nut and washer arrangement is provided at each end of the other bore 28 in block 26. With this arrangement, after loosening the nuts the block 26 may be adjusted to the left or the right along the slots 24 and 25 and then clamped in place in the position to which it has been adjusted. As explained hereinafter, the position of the block 26 to the left or right along the base determines the amount of offset imparted to the conduits being bent by the apparatus.

As shown in FIG. 5, the left end of the block 26 presents a convex face 26a which curves to the right upward. A relatively thick pad of fiber-reinforced rubber 35 is adhesively bonded to this face to provide a deformable resilient cushion for the conduits being bent, as explained hereinafter.

A generally U-shaped operating handle H (FIG. 2) has downwardly-extending extension plates 36 and 37 on its opposite sides which are located just outside the diagonal bars 19 and 23 of the support structure at the base. Near its lower end the handle extension 36 is pivotally mounted at 38 (FIG. 1) on the vertical bar 20 of the support structure a short distance above the side plate 18. The handle extension 37 on the opposite side has a similar pivotal mounting at 39 (FIGS. 3 and 5) on the vertical bar 22 of the support structure extending up from that side of the base. The pivots 38 and 39 are aligned and they define the pivotal axis for the handle H on the base of the apparatus.

Figure 2:
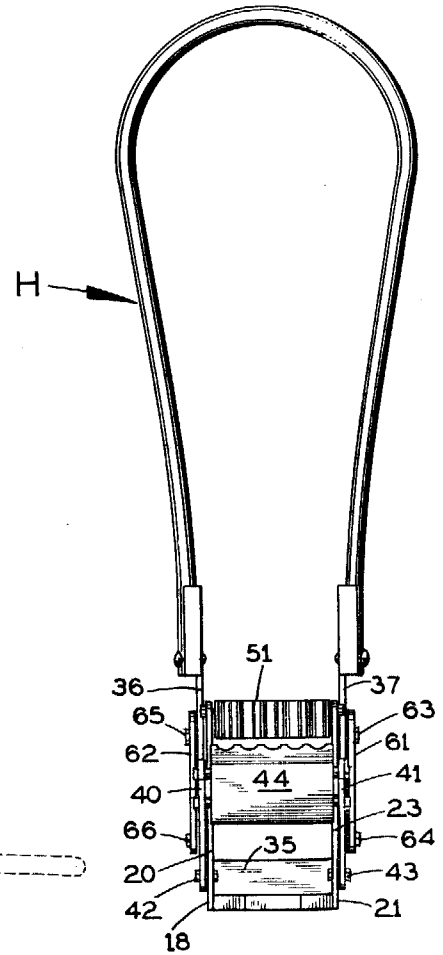
FIG. 2 is a front elevation of this apparatus.

As explained in detail hereinafter, the handle H operates a pair of rocker arms 40 and 41, which are pivotally mounted on the base at its left end in FIG. 1. The respective pivots for these rocker arms, shown at 42 and 43 in FIGS. 1 and 2, are located just to the left of the pad 35 on block 26 carried by the base. A grooved conduit-bending jaw 44 extends between the rocker arms 40 and 41 at their upper ends and at each end is rigidly bolted to each rocker arm. As best seen in FIG. 5, at its right side (i.e., the side toward the handle H) the jaw 44 presents a face 45 which is convex upward from the lower end of the jaw. This convex face 45 is formed with a plurality of laterally spaced, parallel, semicircular grooves 46, 47, 48, 49 and 50 which extend upward from the bottom of the jaw 44 to the top. The longitudinal directional of each groove follows the convex curvature of this side of the jaw 44 from bottom to top, and each groove has a uniform depth along its entire length. In the particular embodiment shown, the two outer grooves 46 and 50 are of larger diameter than the three grooves 47, 48 and 49 in the middle.

A grooved upper block 51 is pivotally supported by a horizontal bolt 52 extending between the upstanding bars 20 and 22 at the opposite sides of the base. The pivotal axis for this block, as shown in FIGS. 1, 4 and 5, is located near the upper ends of the vertical supported bars 20 and 22. This pivotal axis is located vertically above the center of gravity of block 51 so that normally this block hangs vertically, as shown in FIG. 5. The upper block 51 is generally rectangular in cross-section and presents a normally vertical grooved face 53 which faces toward the grooved, generally convex face 45 of the jaw 44. This face 53 of the upper block is flat except for vertically extending grooves 56, 57, 58, 59 and 60 of semi-circular cross-section which are laterally aligned with and the same size as the grooves 46–50 in the jaw 44.

The upper block 51 provides an upper abutment in the apparatus which is located above and behind (i.e., to the right in FIG. 5) the lower abutment provided by the convex cushion 35 on the lower block 26. As shown in FIG. 5, the lower and upper abutments will be located on one side of the conduits to be bent and the pivoted jaw 44 will be located on the opposite side of these conduits.

The pivoted handle H is coupled to the jaw 44 through a pair of rigid linkage arms 61 and 62 located respectively on opposite sides of the base. As shown in FIG. 1, the linkage arm 61 is horizontally pivoted at 63 to the handle extension 36 and is horizontally pivoted at 64 to the rocker arm 40 at one end of the jaw 44. Similarly, as shown in FIG. 5, the linkage arm 62 is horizontally pivoted at 65 to the handle extension 37 and is horizontally pivoted at 66 to the rocker arm 41 at the opposite end of jaw 44.

When the handle H is in its raised position (FIGS. 1 and 5) the jaw 44 is separated from the upper abutment provided by block 51. This is the retracted, lowered position of jaw 44. When the handle is lowered (FIG. 9) it moves the jaw 44 pivotally up toward the upper abutment to form upper and lower bends in the conduits engaged between them, as explained in greater detail hereinafter. This is the extended, raised position of jaw 44.

The present pipe bending apparatus is specifically intended for use on metal conduits in buildings through which the electrical wiring will extend to electrical outlets in the walls of the various rooms of the finished building. Normally, as shown in FIG. 7, such conduits are embedded in a concrete floor of the building and extend up from the floor at the location of a wall in which an outlet will be mounted. Depending upon the wiring layout used, these conduits will be singular, clustered in pairs or in sets of three. In any particular arrangement, the conduit at one end or the other may be either a relatively small diameter conduit or a larger diameter ($\frac{3}{4}$ inch) conduit, as shown in FIG. 7. Whether clustered in a pair or a set of three the conduits usually will be very close together at the floor.

The purpose of the present apparatus is two-fold:

(1) to bend the conduits so that their upper ends are offset to positions as close as possible to the desired final positions at the junction box in the wall behind the electrical outlet; and (2) to spread the conduits apart so that their upper ends will be as far apart as the corresponding openings in the junction box.

In the operation of this apparatus, the lower abutment 26, 35 and the upper abutment 51 are positioned on one side of these conduits, which is the side toward which they will be bent. The pivoted jaw 44 is on the opposite side of these conduits. Initially, the handle H is in the related position shown in FIGS. 1 and 5. The apparatus is positioned so that the lower edge of the pad 35 on the lower abutment just touches the conduits which are to be bent, as shown in FIG. 5.

Figure 9:
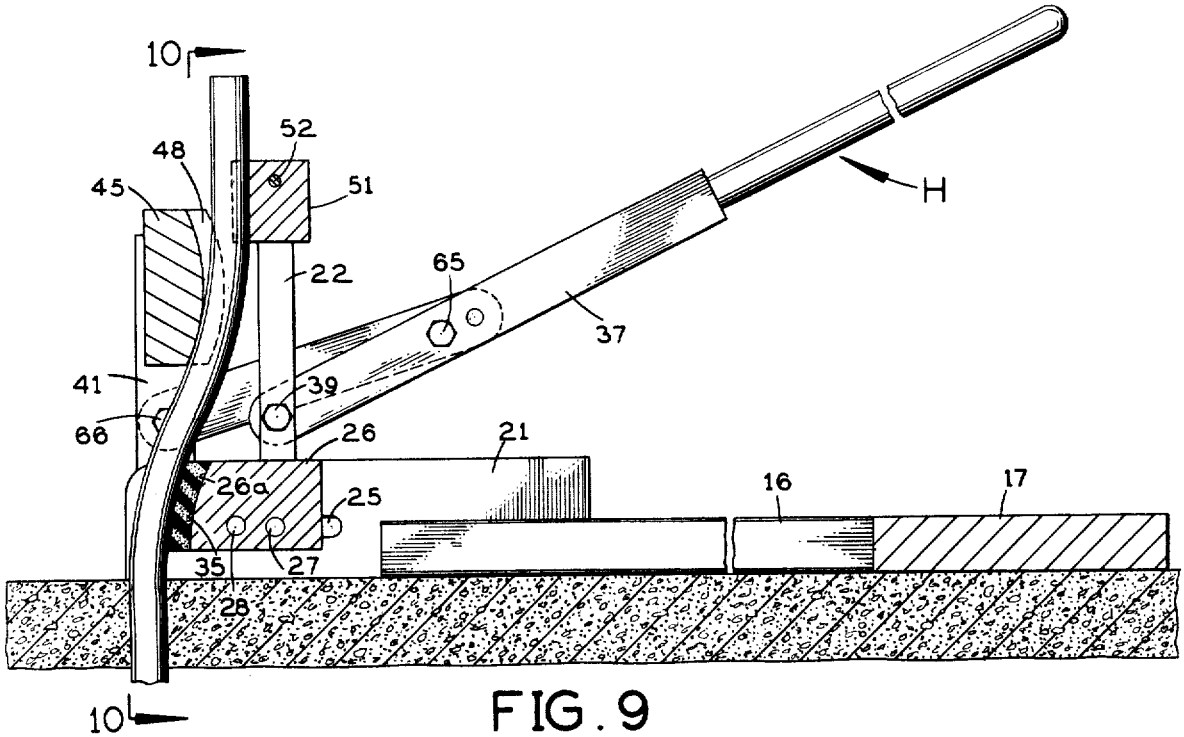
FIG. 9 is a view similar to FIG. 5 and showing the operating handle of the apparatus being lowered for operating the apparatus to bend the conduits.
Figure 10:
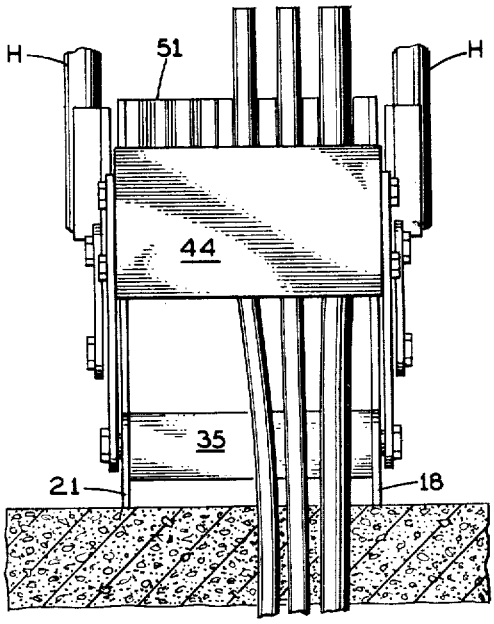
FIG. 10 is a view similar to FIG. 8 and showing the position of the parts during the conduit-bending operation of the apparatus, viewed from the line 10—10 in FIG. 9.
Figure 11:
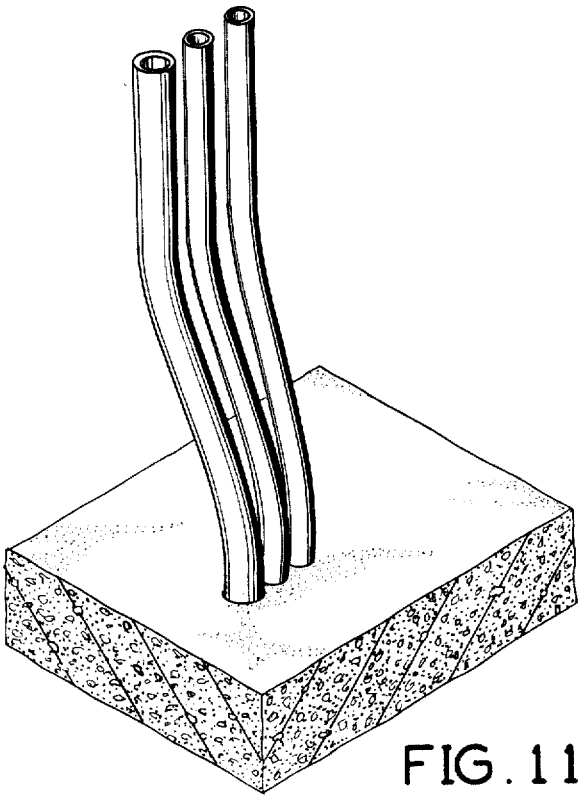
FIG. 11 is a view similar to FIG. 7 showing the conduits after they have been bent.

The operator now forces down the free upper end of handle H. Through the linkage arms 61 and 62 this pivotal movement of the handle causes the jaw 44 to be moved up clockwise in FIG. 5. As shown in FIG. 9, such movement of the jaw 44 causes it to bend the conduits about the pad 35 on the lower abutment. The upper end of each conduit is forced into a corresponding groove in the upper block 51 forming the upper abutment so that two successive bends are formed in each conduit, a lower bend at the pad 35 on the lower abutment and an upper bend of the opposite curvature at the lower half of the jaw 44. This upper bend is located between the top of the lower abutment 26, 35 and the bottom of the upper abutment 51. The upper end of each bent conduit will extend vertically at a location offset from its position in the floor in a direction toward the upper abutment 51. The amount of this offset is determined by the position of the block 26 along the base. This block can be adjusted along the slots 24 and 25 in the base and then clamped tightly in place at the position to which it has been adjusted. In FIGS. 5 and 9, if the block 26 is adjusted farther to the left, a greater offset will be formed in the conduits. Conversely, if the block 26 is adjusted farther to the right in these Figures, the offset formed in the conduits will be reduced.

In addition to offsetting the upper ends of the conduits, the grooved jaw 44 and upper block 51 cooperate to spread the conduits farther apart than their positions in the floor. The lateral spacing of the grooves in jaw 44 and block 51 accomplishes this, spreading the upper ends of the two or three conduits to positions corresponding to the locations of corresponding openings in the junction box.

If desired, the jaw 44 may be moved from its retracted position (FIG. 5) to its extended position (FIG. 9) by a mechanical linkage different from the one shown. Also, if desired, the jaw 44 may move back and forth horizontally rather than arcuately between its retracted and extended positions.

When the conduit to be bent is relatively thick-walled or of large diameter, the jaw 44 may be operated from an electric, pneumatic or hydraulic motor instead of from a manually operated mechanical linkage, as shown.

We claim:

1. An apparatus for bending a plurality of closely spaced conduits extending up from a floor, said apparatus comprising:

a base;

means providing a lower abutment on one side of the conduits;

means providing an upper abutment on said one side of the conduits spaced above and behind said lower abutment;

a jaw mounted to be located on the opposite side of the conduits and movable between a retracted position away from said upper abutment and an extended position toward said upper abutment and above said lower abutment;

and means for moving said jaw from said retracted position to said extended position to form lower bends in the conduits against said lower abutment in one direction and to form upper bends in the conduits against said jaw in the opposite direction from said lower bends, whereby to offset the upper ends of the conduits substantially parallel to their lower ends at the floor;

said jaw having a width to receive all of said plurality of conduits simultaneously and a plurality of conduit-receiving grooves which are spaced apart laterally across said jaw to define the lateral spacing between the upper ends of said conduits above said upper bends therein;

means on said base for adjusting said lower abutment means toward or away from said jaw at the front of said upper abutment means so as to change the amount of the offset formed in the conduits by said lower and upper bends therein;

and means on said upper abutment means presenting a plurality of vertical grooves which are aligned respectively with said grooves in said jaw to further position the upper ends of said conduits.

2. An apparatus according to claim 1, wherein said jaw has a face which is convex upward from its lower end and which engages said opposite side of the conduits above said lower abutment and below said upper abutment upon movement of the jaw from its retracted position to its extended position, whereby to form the upper bends in said conduits between said lower and upper abutments.

3. An apparatus according to claim 2, wherein said jaw is horizontally pivoted below said upper abutment means for movement arcuately upward from its retracted position to its extended position.

4. An apparatus according to claim 3, wherein said lower abutment means has a conduit-engaging convex face which curves upward away from said one side of the conduits to form said lower bend in the conduits upon movement of said jaw to its extended position.

5. An apparatus according to claim 4, wherein said lower abutment means has a deformable resilient cushion on its convex face for engagement by said one side of the conduits.

6. An apparatus according to claim 2, wherein said lower abutment means has a conduit-engaging face which curves upward away from said one side of the conduits.

7. An apparatus according to claim 6, wherein said lower abutment means has a deformable resilient cushion on its conduit-engaging face.

* * * * *